United States Patent [19]

Arai et al.

[11] Patent Number: 4,636,409

[45] Date of Patent: Jan. 13, 1987

[54] RECORDING MEDIUM

[75] Inventors: Ryuichi Arai; Shigeo Toganoh, both of Tokyo, Japan

[73] Assignee: Canon Kabushiki Kaisha, Tokyo, Japan

[21] Appl. No.: 650,177

[22] Filed: Sep. 13, 1984

[30] Foreign Application Priority Data

Sep. 19, 1983 [JP] Japan ..... 58-171377
Sep. 19, 1983 [JP] Japan ..... 58-171378

[51] Int. Cl.[4] ..... B41M 5/00

[52] U.S. Cl. ..... 427/256; 346/1.1; 346/135.1; 427/212; 427/261; 427/288; 428/143; 428/144; 428/145; 428/148; 428/149; 428/150; 428/206; 428/211; 428/323; 428/328; 428/329; 428/331; 428/336; 428/537.5

[58] Field of Search ..... 346/135.1, 1.1; 428/207, 211, 323, 328, 330, 331, 537.5, 141, 143–145, 148–150, 206, 219, 329, 336

[56] References Cited

U.S. PATENT DOCUMENTS 4,481,244 11/1984 Haruta et al. ..... 428/211
4,496,629 1/1985 Haruta et al. ..... 428/211

*Primary Examiner*—Bruce H. Hess
*Attorney, Agent, or Firm*—Fitzpatrick, Cella, Harper & Scinto

[57] ABSTRACT

An ink-jet recording medium is characterized in that the recording surface thereof is formed of a mixture of at least a filler and parts of a fibrous base material and that parts of the fiber composing the fibrous base material are laid very closely to the recording surface.

17 Claims, 6 Drawing Figures

RECORDING MEDIUM

BACKGROUND OF THE INVENTION

1. Field of the Invention

The present invention relates to recording media such as recording paper for ink-jet recording which have high ink (recording liquid) absorption ability and a moderate ink diffusing property and give a high picture element density (optical density of a picture element) as well as a good shape ink dot.

2. Description of the Prior Art

The ink-jet recording process is a recording method in which ink droplets are ejected through nozzles by an ink discharge technique such as electrostatic attraction caused by high voltage application, imparting mechanical vibration or displacement to the ink by means of piezo-electric elements, or some other technique, and are caused to adhere onto a recording medium. This recording method generates limited noise and permits high speed printing and multicolor printing.

For ink-jet recording, water-base inks are chiefly used in view of safety and aptitude for printing and generally comprise a colorant and a liquid medium.

Recording media hitherto used generally for ink-jet recording are sheets of common plain paper. However, improvements in the performance of ink-jet recorders, such as increased recording speed and the capability of multicolor recording, are accompanied by growing needs for ink-jet recording media to meet more demanding specifications.

The required characteristics are as follows: (1) Ink absorption must be as fast as possible. (2) An ink dot, when superposed upon a previously provided ink dot, does not breed thereinto. (3) The ink dots must have a precise and uniform diameter. (4) The ink dots have shapes close to a perfect circle and smooth outlines. (5) Recording media must have high brightness. (6) Colorants in inks applied must present good colors.

On the other hand, in ink-jet recording, original images are reproduced generally in a way such that the original image to be recorded is finely divided into equal sections (picture elements) and each of the picture elements is expressed with one ink dot or plural ink dots. In such a recording system, a sufficient picture element density (overall optical density of each picture element reproduced) is necessary in order to give a sufficient optical density to recorded images. For instance, when one picture element is expressed with one ink dot by the use of a definite amount of ink droplet of a definite colorant concentration, the ink droplet applied should spread as uniformly as possible over the entire area of the picture element. The reason for this is as follows: When the diameter of the ink dot fixed in a picture element is small, the overall density of the picture element is generally low, though the density of the ink dot itself is high; on the contrary, when the diameter of the ink dot fixed is large, the overall density of the picture element is high, though the density of the ink dot itself is low; and when the ink droplet spreads over the entire area of the picture element, the overall picture element density is maximized. This is because the overall picture element density depends mainly upon the inked area relative to the non-inked area.

On a recording medium having a higher ink diffusing property, recording can be carried out at a higher speed by increasing the area of each picture element.

Accordingly, it is desirable for ink-jet recording media to have, in addition to the above cited characteristics, such a moderate ink diffusing property that an ink droplet applied on a picture element having a prescribed area will spread uniformly over the entire area thereof.

For instance, when common wood-free paper is used for ink-jet recording, the ink absorption therein is bad, the diameter of resulting ink dots is not sufficiently large, the shape thereof is much inferior, and the desired high, uniform picture element density cannot be obtained. Commercial non-coated paper also gives unsatisfactory results though the ink-absorption therein is sufficient, that is, ink runs along fibers of the paper, the degree of ink diffusion varies from point to point on the paper, the shape and size of ink dots are difficult to control, and the density of ink dots varies locally, giving no uniform picture element density.

SUMMARY OF THE INVENTION

An object of the present invention is to provide an ink-jet recording medium which satisfies such requirements as stated above, has a high ink absorption ability and such a suitable ink diffusing property as to spread uniformly an ink droplet applied on a picture element having a predetermined size, over the entire area of the element, results in a good shape of ink dot, and is excellent in coloration.

Another object of the present invention is to provide an ink-jet recording medium which permits controlling the ink dots marked thereupon with the same amount of ink droplets, to have the intended diameter that is adapted to the size of picture elements.

A further object of the present invention is to provide an ink-jet recording medium on which larger ink dots can be marked than on conventional recording media, whereby the speed of recording can be increased with the area of picture element enlarged.

According to one aspect of the present invention, there is provided an ink-jet recording medium characterized in that the recording surface thereof is formed of a mixture of at least a filler and parts of a fibrous base material and that parts of the fiber composing the fibrous base material are laid very closely to the recording surface.

According to another aspect of the present invention, there is provided an ink-jet recording medium characterized in that a superficial layer thereof consists of a mixture of a filler and a fibrous base material.

DESCRIPTION OF THE PREFERRED EMBODIMENTS

Figure 1:
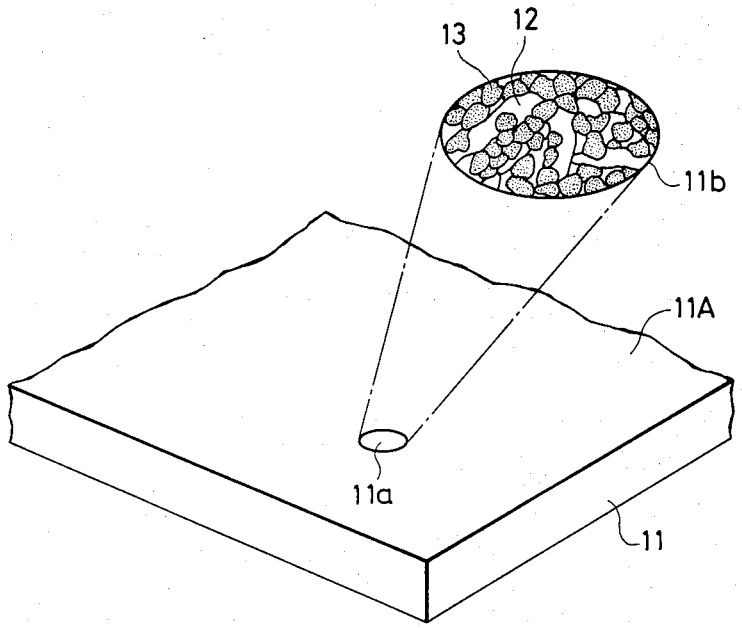
FIG. 1 is a schematic perspective view of the recording surface, including an schematic enlarged view of a part thereof, of an embodiment of the recording medium according to the invention.

Referring now to the drawings, the invention is described in detail.

The recording medium of the invention is featured by the unique structure of the ink receiving surface thereof.

The recording medium of the present invention consists basically of a base material composed mainly of a fibrous material and filler particles attached onto the surface of base material layer. The filler particles are very thinly scattered and attached onto the surface of the base material layer to such an extent that the main component fiber of the base material is not completely covered. The recording surface of the recording medium is in such a state. A typical example of the surface state is shown by the schematic view of FIG. 1.

As shown in FIG. 1 by the enlarged schematic view 11*b* of a part 11*a* of the recording medium 11 according to the invention, particles 13 of the filler are fixed on the surface of the base material (not depicted) layer through a binder (not depicted). Some parts of the fiber which is the main component of the fibrous base material are covered lightly with filler particles 13 and other parts of the fiber 12 are in direct contact with the outside atmosphere. The filler particles 13 not only lightly cover parts of the fiber 12 but also exist in spaces between individual fibers 12. Thus, the filler particles 13 are fixed on parts of the fiber 12 so as either to partly cover the recording side of the fibrous material to such an extent that some parts of the fiber 12 will appear on the recording surface or to fill spaces between parts of the fiber 12; parts of the fiber 12 exist very closely to the recording surface of the recording medium.

Furthermore, the recording surface of the recording medium according to the invention may be covered with filler particles throughout to such an extent that some parts of the fiber will appear on the recording surface; parts of the fiber exist very closely to the recording surface of the recording medium.

Figure 2:
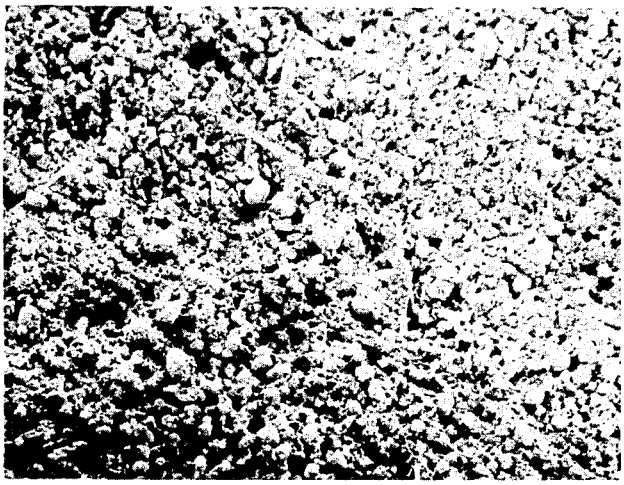
FIG. 2 is a scanning electron microscopic photograph (magnitication factor: 150) of a part of the recording surface shown in FIG. 1.

FIG. 2 is a scanning electron microscopic photograph (magnification factor: 150) of a part of the recording surface shown in FIG. 1. This photograph well demonstrates such a characteristic state of the recording surface, as described above, of the recording medium according to the invention.

Figure 3:
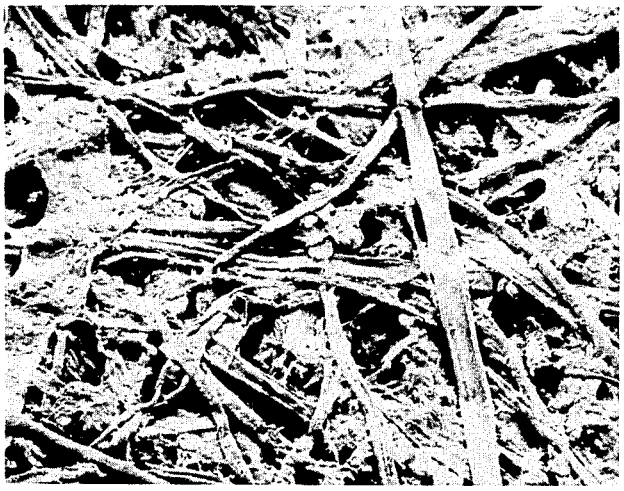
FIG. 3 is a scanning electron microscopic photograph (magnification factor: 150) of a part of the recording surface of a conventional ink-jet recording paper.

FIG. 3, on the other hand, is a scanning electron microscopic photograph (the same magnification factor) of a part of the recording surface of a conventional recording medium (tradename: Ink-Jet Recording Paper L, supplied by Mitsubishi, Paper Mills, Ltd.). This photograph well indicates the recording surface structure of the recording medium wherein numerous pulp fibers lie one upon another. This structure is clearly distinct from the surface structure of the recording medium according to the invention.

The recording surface 11A of the recording medium according to the invention, as described above, is formed of a mixture of at least the filler particles 13 and parts of the fiber 12 which is the main component of the base material. When recording is carried out on the recording surface 11A, ink droplets attached onto the recording surface 11A are absorbed chiefly in the superficial region comprising a mixture of part of the fiber 12 with filler particles 13, and scarcely absorbed in the internal fiber layer. That is, the ink diffuses practically not toward the depth of the recording medium but in the directions parallel to the surface thereof. Accordingly, ink dots each having an area as large as the predetermined area of the picture element can be marked on the present recording medium, which has a property of diffusing ink droplets to a reasonably great extent.

According to another preferred embodiment of the invention, the recording medium of the invention is also featured by the unique structure of the ink receiving layer.

That is, the recording medium of the invention consists basically of (1) a base material composed mainly of a fibrous material and (2) filler particles which are very scarcely attached onto the surface of the base material layer. Thus, the ink receiving surface layer of the recording medium consists of a mixture of at least the filler particles with parts of the fiber composing the base material.

Figure 4:
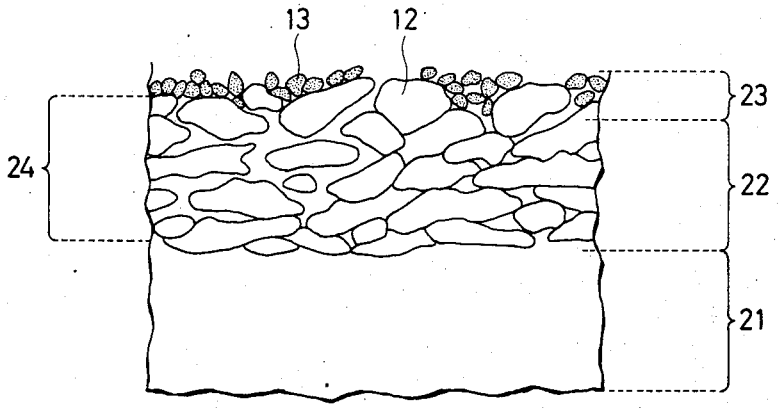
FIG. 4 is a schematic cross-sectional view of another embodiment of the recording medium according to the invention, taken in the direction perpendicular to the surface.

FIG. 4 is a partially sectional schematic view of the surface layer of a typical example of the recording medium according to the invention, taken in the direction perpendicular to the surface.

The recording medium of the invention shown in FIG. 4 consists basically of a top layer (surface layer) 23, middle layer 22, and bottom layer 21.

The top layer 23 consists of a mixture of at least filler particles 13 and part of the fiber 12 composing a fibrous base material 24. This layer 23 receives most of the ink during recording.

The middle layer 22, positioned under the top layer 23, consists of the base material 24, containing no filler particle but consisting mainly of fiber 12. This layer 22 scarcely absorbs ink.

The bottom layer 21, positioned under the middle layer 22, may consist of either the base material 24 alone similarly to the middle layer 22 or some other suitable material.

Also in this case, filler particles 13 are very thinly scattered and fixed onto the upper side of the base material 24 through a binder (not depicted). In the top layer 23, some parts of the fiber 12 are lightly covered with filler particles 13 and other parts of the fiber 12 are in direct contact with the external atmosphere. The filler particles 13 not only cover fiber 12 lightly but also fill spaces between individual fibers 12. Thus, the top layer 23 of this recording medium, according to the invention, also consists of a mixture of at least filter particles 13 and parts of the fiber 12 which is the main component of the base material 24.

Figure 5:
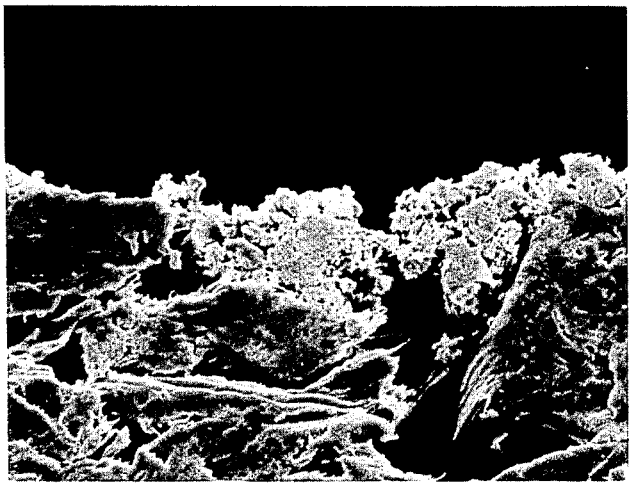
FIG. 5 is a scanning electron microscopic photograph (magnification factor: 1500) of a part of the cross section shown in FIG. 4.

FIG. 5 is a scanning electron microscopic photograph (magnification factor: 1500) of a part of the cross section shown in FIG. 4, of the top layer. This photograph also well demonstrates the state of the surface layer, wherein filler particles are very thinly scattered and fixed onto the upper side of the base material layer through a binder and thus the surface layer consists of a mixture of filler particles with parts of the fiber which is the main component of the base material.

Figure 6:
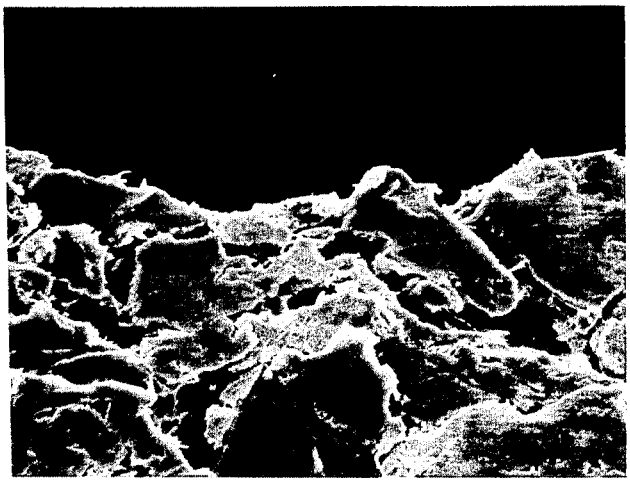
FIG. 6 is a scanning electron microscopic photograph (magnification factor: 1500) of a part of a cross section of a conventional ink-jet recording paper, taken in the direction perpendicular to the surface.

FIG. 6, on othe other hand, is a scanning electron microscopic photograph (magnification factor: 1500) of a part of a cross section perpendicular to the surface, of a conventional ink-jet recording medium (tradename: Ink-Jet Recording Paper L, supplied by Mitsubishi Paper Mills, Ltd.). This photograph well indicates the structure of the surface layer wherein numerous pulp fibers lie one upon another. This structure is clearly distinguished from that of the recording medium according to the invention.

When recording is made on the recording medium of the invention which has the surface layer described above, ink droplets attached to the surface is absorbed chiefly in the top layer 23 consisting of a mixture of fiber 12 with filler particles 13, and scarcely absorbed in the middle layer 22 lying in the interior of the recording medium. That is, the ink diffuses practically not toward the depth of the recording medium but in the directions parallel to the surface thereof.

This can be explained as follows: Since the average particle size of the filler is smaller than the average diameter of the pulp fiber, the filler has a larger specific surface area (surface area per unit weight) than the fiber. On the other hand, ink is absorbed in the recording medium by the action of the surface energy of the filler or the fiber, that is, ink is more readily absorbed in a material having greater surface energy, in other words, in the portion consisting of numerous fillers having greater surface energy than in the portion consisting of fiber. In the recording medium of the invention, filler particles are very thinly scattered and fixed on the surface layer and the surface area of materials in the surface is larger than that in the inner region. Due to the difference in absorption rate between the surface layer and the inner region, ink droplets diffuse at a higher rate in the directions parallel to the surface than in the direction perpendicular thereto. Therefore the recording medium of the invention exhibits a high ink diffusion ability and a high rate of ink absorption, and the ink dot size can be enlarged to the predetermined size of the picture element.

For the base material, which is composed mainly of a fibrous material, of the recording medium according to the invention, paper is suited while cloth and synthetic paper can also be used. For the purpose of further suppressing the diffusion of ink toward the depth of the recording medium, it is preferable to use a fibrous base material the liquid absorption ability of which has been lowered by sizing or other suitable method. The base material can be supported by a suitable material such as a resin film.

For the material composing the bottom layer 21, there may be employed the suitable one which can be used as support such as resin film, etc. in addition to cloth, paper and synthetic paper used for the base material.

For the filler, another basic component of the recording medium according to the invention, there may be used, for example, silica, clay, talc, kaolin, diatomaceous earth, calcium carbonate, calcium sulfate, satin white, aluminum silicate, alumina, zeolite, and the like. These fillers can be used alone or in combination.

It is desirable that particle sizes of the filler used be 0.05 to 50 $\mu$m, particularly 0.1 to 20 $\mu$m, for the purpose of fixing the filler particles 13 onto parts of the fiber 12 and in spaces therebetween so as to leave some parts of the fiber 12 on the recording surface 11A or fixing the filler particles 13 on the layer of the base material 24 so as to form the top layer 23 consisting of a mixture of parts of the fiber 12 with the filler particles 13, and for the purpose of giving a high ink absorption ability and a suitable ink spreading property to the surface layer of the recording medium. Too large filler particles are undesirable, since such fillers cause nonuniform spread of ink on the recording surface and hence result in difficulties in controlling the size and shape of ink dots.

Further, when a porous filler is used in the surface layer of the recording medium, ink droplets applied on the surface diffuse into pores of the filler and the coloring component (e.g. dye or pigment) of the diffusing ink is adsorbed in the pores, whereby good coloration can be achieved.

Suitable binders for fixing the filler on the layer of the base material include; water-soluble polymers such as starch, gelatin, casein, gum arabic, sodium alginate, carboxymethylcellulose, poly(vinyl alcohol), poly(vinylpyrrolidone), sodium polyacrylate, polyacrylamide, and the like; synthetic polymer latexes such as synthetic rubber latexes, and the like; and organic solvent-soluble polymers such as poly(vinyl butyral), poly(vinyl chloride), poly(vinyl acetate), polyacrylonitrile, poly(methyl methacrylate), poly(vinyl formal), melamine resin, polyamide, phenolic resin, polyurethane, alkyd resin, and the like.

In the surface layer of the recording medium according to the invention, pigments (other than the filler) such as plastic pigments and further various additives can be incorporated together with the filler, unless impairing the effect of the invention. Such additives include, e.g. dispersants, fluorescent dyes, pH regulators, deforming agents, lubricants, preservatives, surfactants, and the like.

The recording medium can be produced by dispersing chiefly the above stated filler and binder in a medium such as water to give a coating liquid, applying the coating liquid on the above stated base material with a roll coater, rod bar coater, spray coater, air-knife coater, or some other coater, and drying the coated material as fast as possible.

Suitable weight ratios of the filler to the binder in the coating liquid are generally 100:10 to 100:150. When the average particle size of the filler is relatively large, good results are obtained by minimizing the proportion of the binder. The weight (per unit area) of the coat including the filler, the binder, and if required, other components is chosen depending upon the quantity of one droplet of ink and the ink dot diameter intended to meet the size of the picture element. That is to say, the diameter of the ink dot can be increased by decreasing the weight of the coat. The dry coating weight generally in the range of approximately from 1 to 30 g/m$^2$, where the thickness of the surface layer 3 becomes in the range of approximately from 0.5 to 10 $\mu$m.

The recording medium of the invention having a surface layer of unique structure, as described hereinbefore, has a high ink absorption ability and such a suitable ink diffusing property as to spread each of the applied ink droplets uniformly over the entire area of the picture element, thus resulting in a good shape of ink dot and a sufficient picture element density with good coloration.

In addition, it has become possible according to the invention that the diameter of the ink dot to be marked with a definite quantity of an ink droplet can be controlled to fit the area of the picture element by varying the weight per unit area of the coat. Moreover, by the recording medium of the invention, ink dots with a larger diameter can be marked and hence recording can be carried out at a higher speed with a larger area of picture element, than on conventional recording media.

The invention is illustrated in more detail with reference to the following examples. In the examples, all "parts" are by weight.

EXAMPLE 1

A coating liquid of the following composition was prepared by using precipitated calcium carbonate (average particle size: 1 μm) as filler and poly (vinyl alcohol) and SBR latex as binders.

| Composition: | |
|---|---|
| Precipitated calcium carbonate | 100 parts |
| Poly(vinyl alcohol) | 25 parts |
| SBR latex | 5 parts |
| Water | 500 parts |

The coating liquid was applied on a common wood-free paper (basic weight: 65 g/m$^2$), a fibrous base material, having a sizing degree of 35 sec., as measured in accordance with JIS P 8122, by means of a blade coater so as to give a dry coating weight of 2 g/m$^2$. The coated paper was dried in the usual way to prepare a recording medium. FIG. 2 is a scanning electron microscopic photograph (magnification factor: 150) of the recording surface of this recording medium.

On this recording medium, color ink-jet recording was made by using the following inks of four different colors under the conditions of droplet diameter 90 μm and picture element size 300 μm×300 μm.

| | |
|---|---|
| Yellow ink (composition): | |
| C.I. Acid Yellow 23 | 2 parts |
| Diethylene glycol | 30 parts |
| Water | 70 parts |
| Magenta ink (composition): | |
| C.I. Acid Red 92 | 2 parts |
| Diethylene glycol | 30 parts |
| Water | 70 parts |
| Cyan ink (composition): | |
| C.I. Direct Blue 86 | 2 parts |
| Diethylene glycol | 30 parts |
| Water | 70 parts |
| Black ink (composition): | |
| C.I. Direct Black 19 | 2 parts |
| Diethylene glycol | 30 parts |
| Water | 70 parts |

Recording characteristics of this recording medium were evaluated by the following measurements. Results of the evalution are shown in Table 1.

(1) Density of picture element: Reflection optical density of the specimen obtained by applying droplets of the black ink on all the picture elements were measured with a photographic densitometer, NLM-STD-Tr, (supplied by Narumi Co., Ltd.).

(2) Shape of ink dot: Ink dots fixed on the specimen were observed with a stereomicroscope. The observed shapes are rated as follows:
Almost right circle . . . o
Slightly irregular circle . . . Δ
Irregular shape . . . X (3) Degree of ink diffusion: Diameters (D) of ink dots fixed on the specimen were measured with a stereomicroscope. Results thereof are shown by the ratio D/d, wherein d is the diameter of ink droplets used.

(4) Clearness of colors: Colors of images formed on specimens by ink-jet recording were compared with one another by visual observation. The colors are shown by ◎, o, Δ, and X in the order of from best to worst clearness.

(5) Ink absorption ability: Two ink dots of different colors were superposed upon each other on the specimen. Samples causing no bleeding of the ink and giving clear images are represented by the marks o and those doing otherwise by the mark X.

EXAMPLE 2

A coating liquid of the following composition was prepared by using silica (tradename: Nipsil E 220A, supplied by Nippon Silica Kogyo Co., Ltd., average particle size: 1.0 μm) as filler and starch and SBR latex as binders.

| Composition: | |
|---|---|
| Silica | 100 parts |
| Starch | 30 parts |
| SBR latex | 10 parts |
| Water | 300 parts |

This coating liquid was applied on the same common wood-free paper, a fibrous base material, as used in Example 1, by means of a blade coater so as to give a dry coating weight of 2 g/m$^2$. The coated paper was dried in the usual way to prepare a recording medium. A scanning electron microscopic photograph (magnification factor: 150) of the recording surface of this recording medium was nearly the same in appearance as the one, shown by FIG. 2, taken in Example 1.

Results of evaluating recording characteristics of this recording medium in the same manner as in Example 1 are shown in Table 1.

EXAMPLE 3

A coating liquid of the following composition was prepared by using kaolin (average particle size: 2 μm) as filler and casein as binder.

| Composition: | |
|---|---|
| Kaolin | 100 parts |
| Casein | 20 parts |
| Water | 500 parts |

This coating liquid was applied on the same common wood-free paper, a fibrous base material, as used in Example 1, by means a blade coater so as to give a dry coating weight of 5 g/m$^2$. The coated paper was dried in the usual way to prepare a recording medium.

A scanning electron microscopic photograph (magnification factor: 150) of the recording surface of this recording medium was also nearly the same in appearance as the one, shown by FIG. 2, taken in Example 1.

Results of evaluating recording characteristics of this recording medium in the same manner as in Example 1 are shown in Table 1.

COMPARATIVE EXAMPLE 1

A commercial ink-jet recording paper (tradename: Ink-Jet Recording Paper L, supplied by Mitsubishi Paper Mills, Ltd.) was evaluated for recording characteristics in the same manner as in Example 1. Results thereof are shown in Table 1. FIG. 3 is a scanning electron microscopic photograph (magnification factor: 150) of the recording surface of this recording paper.

EXAMPLE 4

A coating liquid of the following composition was prepared by using calcium carbonate (average particle size: 1 μm) as filler and starch and SBR latex as binders.

| Composition: | |
|---|---|
| Calcium carbonate | 100 parts |
| Starch | 30 parts |
| SBR latex | 10 parts |
| Water | 300 parts |

This coating liquid was applied on the same common wood-free paper as used in Example 1 by means of a blade coater so as to give a dry coating weight of 3 g/m$^2$. The coated paper was dried in the usual way to prepare a recording medium. FIG. 5 is a scanning electromicroscopic photograph (magnification factor: 1500) showing a cross section of this recording medium, perpendicular to the surface.

Results of evaluating recording characteristics of this recording medium are shown in Table 2.

EXAMPLE 5

A coating liquid of the following composition was prepared by using silica (the same as used in Example 2) as filler and poly(vinyl alcohol) and SBR latex as binders.

| Composition: | |
|---|---|
| Silica | 100 parts |
| Poly(vinyl alcohol) | 25 parts |
| SBR latex | 5 parts |
| Water | 500 parts |

This coating liquid was applied on the same common wood-free paper as used in Example 1 by means of a blade coater so as to give a dry coating weight of 2 g/m$^2$. The coated paper was dried in the usual way to prepare a recording medium.

A scanning electron microscopic photograph (magnification factor: 1500) of a cross section of this recording medium, perpendicular to the surface was nearly the same in appearance as the one, shown by FIG. 5, taken in Example 4.

Restuls of evaluating recording characteristics of this recording medium in the same manner as in Example 1 are shown in Table 2.

EXAMPLE 6

A coating liquid of the following composition was prepared by using talc (average particle size: 1 μm) as filler and casein as binder.

| Composition: | |
|---|---|
| Talc | 100 parts |
| Casein | 20 parts |
| Water | 500 parts |

This coating liquid was applied on the same common wood-free paper as used in Example 1 by means of a blade coater so as to give a dry coating weight of 2 g/m$^2$. The coated paper was dried in the usual way to prepare a recording medium.

A scanning electron microscopic photograph (magnification factor: 1500) of a cross section of this recording medium, perpendicular to the surface was also nearly the same in appearance as the one, shown by FIG. 5, taken in Example 4.

Results of evaluating recording characteristics of this recording medium in the same manner as in Example 1 are shown in Table 2.

COMPARATIVE EXAMPLE 2

Recording characteristics of a commercial ink-jet recording paper (the same as used in Comparative Example 1) were evaluated in the same manner as in Example 1. Results thereof are shown in Table 2. FIG. 6 is a scanning electron microscopic photograph (magnification factor: 1500) of a cross section of this recording paper, perpendicular to the surface.

TABLE 1

| Item (ink used) | Example 1 | Example 2 | Example 3 | Comparative Example 1 |
|---|---|---|---|---|
| Density of picture element (black) | 0.70 | 0.62 | 0.55 | 0.35 |
| Shape of ink dot (black) | o | o | o | o |
| Degree of ink diffusion (black) | 4.6 | 4.1 | 3.6 | 3.5 |
| Clearness of color (yellow) | o | ◎ | o | X |
| Clearness of color (red) | ◎ | ◎ | Δ | X |
| Clearness of color (blue) | ◎ | ◎ | o | X |
| Ink absorption ability (black) | o | o | o | X |

TABLE 2

| Item (ink used) | Example 4 | Example 5 | Example 6 | Comparative Example 2 |
|---|---|---|---|---|
| Density of picture element (black) | 0.66 | 0.72 | 0.68 | 0.35 |
| Shape of ink dot (black) | o | o | o | o |
| Degree of ink diffusion (black) | 4.0 | 4.5 | 4.3 | 3.5 |
| Clearness of color (yellow) | o | ◎ | o | X |
| Clearness of color (red) | ◎ | ◎ | Δ | X |
| Clearness of color (blue) | ◎ | ◎ | o | X |
| Ink absorption ability (black) | o | o | o | X |

What is claimed is:

1. An ink-jet recording medium comprising a layer of fibrous material having filler particles bound thereto providing at the surface of the recording medium a recording surface layer containing a mixture of said filler particles and said fibrous material, wherein said layer of fibrous material comprises a base layer underlying said recording surface layer.

2. The ink-jet recording medium of claim 1, wherein the sizes of the filler particles are in the range of 0.05 to 50 μm.

3. The ink-jet recording medium of claim 1, wherein the base layer is paper.

4. The ink-jet recording medium of claim 1, wherein a binder is interposed between the filler particles and the fibrous material.

5. The ink-jet recording medium of claim 1, wherein the filler particles consist of the least one member selected from silica, clay, talc, kaolin, diatomaceous earth, calcium carbonate, calcium sulfate, satin white, aluminum silicate, alumina, and zeolite.

6. The ink-jet recording medium of claim 1, wherein the thickness of the recording surface lever is in the range of 0.5 to 10 $\mu$m.

7. The ink-jet recording medium of claim 1, wherein the layer of fibrous material is a superficial layer of a paper sheet.

8. The ink-jet recording medium of claim 1, wherein at least some of said filler particles and at least some of said fibrous material are exposed at the surface of said recording surface layer.

9. The ink-jet recording medium of claim 1, wherein at least some of said filler particles and at least some of said fibrous material are exposed at the surface of said recording layer and said filler particles are bound to the surface of said base layer by a binder.

10. The ink-jet recording medium of claim 1, further comprising a bottom support layer underlaying said base layer.

11. The ink-jet recording medium of claim 10, wherein said bottom support layer includes a material different from said base layer.

12. A method of ink-jet recording comprising the steps of:

providing an ink-jet recording medium comprising a layer of fibrous material having filler particles bound thereto providing at the surface of the recording medium a recording surface layer containing a mixture of said filler particles and said fibrous material, wherein said layer of fibrous material comprises a base layer underlying said recording surface layer; and depositing ink on said medium.

13. The ink-jet recording method of claim 12, wherein said depositing step including forming droplets of ink of a plurality of colors, including black.

14. The ink-jet recording method of claim 12, wherein at least some of said filler particles and at least some of said fibrous material are exposed at the surface of said recording surface layer.

15. The ink-jet recording method of claim 12, wherein at least some of said filler particles and at least some of said fibrous materials are exposed at the surface of said recording surface layer and said filler particles are bound to the surface of said base layer by a binder.

16. The ink-jet recording method of claim 12, further comprising a bottom support layer underlying said base layer.

17. The ink-jet recording method of claim 16, wherein said bottom support layer includes a material different from said base layer.

* * * * *